US010968634B2

(12) United States Patent
Bolo

(10) Patent No.: US 10,968,634 B2
(45) Date of Patent: Apr. 6, 2021

(54) COVERING SYSTEM

(71) Applicant: Scott Timothy Bolo, Miami, FL (US)

(72) Inventor: Scott Timothy Bolo, Miami, FL (US)

( * ) Notice: Subject to any disclaimer, the term of this patent is extended or adjusted under 35 U.S.C. 154(b) by 0 days.

(21) Appl. No.: 14/276,975

(22) Filed: May 13, 2014

(65) Prior Publication Data

US 2014/0331588 A1 Nov. 13, 2014

Related U.S. Application Data

(60) Provisional application No. 61/855,246, filed on May 13, 2013.

(51) Int. Cl.
*E04D 1/34* (2006.01)
*E04D 3/361* (2006.01)

(52) U.S. Cl.
CPC ..... *E04D 3/361* (2013.01)

(58) Field of Classification Search
USPC ..... 52/543, 544, 545, 546, 547, 24, 25
See application file for complete search history.

(56) References Cited

U.S. PATENT DOCUMENTS 4,034,532 A * 7/1977 Reinwall, Jr. ..... 52/520
4,651,489 A * 3/1987 Hodges et al. ..... 52/409
5,001,881 A * 3/1991 Boyd ..... 52/545
5,181,360 A * 1/1993 Shingler ..... 52/520
5,535,567 A * 7/1996 Cahoon ..... 52/520
7,281,359 B2 * 10/2007 Marshall ..... 52/712
7,634,882 B1 * 12/2009 Briggs et al. ..... 52/520
7,874,117 B1 * 1/2011 Simpson ..... 52/520
7,963,083 B1 * 6/2011 Briggs et al. ..... 52/520
8,122,667 B2 * 2/2012 Ferge et al. ..... 52/544
2002/0088196 A1 * 7/2002 Haddock ..... 52/543
2003/0145548 A1 * 8/2003 Mitchell ..... 52/536
2008/0250742 A1 * 10/2008 Smola et al. ..... 52/543
2010/0326000 A1 * 12/2010 Garcia ..... 52/520

* cited by examiner

*Primary Examiner* — Mark Wendell
*Assistant Examiner* — Keith Minter

(57) ABSTRACT

A covering system provides a structural insulated panel for covering a roof having standing seams. The insulation is a composite core made of EPS and other polymers such as polyurethane. At least one panel covers a mounting surface, like a roof, and at least one protruding seam on the roof. The panel utilize a deformation, or crimping to form connections with adjacent panels and attachments with the mounting surface. A bracket fastens to the mounting surface by crimping onto the protruding seam. An exterior portion includes a pair of stabilizers that extend outwardly. A pair of stabilizer ends crimp onto a support portion of the mounting bracket for fastening. The crimping mechanism minimizes the need for penetrating the mounting surface with fasteners and reduces space between seams.

20 Claims, 4 Drawing Sheets

COVERING SYSTEM

CROSS-REFERENCE TO RELATED APPLICATIONS

The present Utility patent application claims priority benefit of the U.S. provisional application for patent Ser. No. 61/855,246, entitled "Roof System Comprised of Insulated Standing Seam Metal Panels", and filed on May 13, 2013 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a covering system. More particularly, the invention relates to covering panels that form connections by attaching through crimping onto each other.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a roof is part of a building envelope. The roof may include both the covering on the uppermost part of a building or shelter which provides protection from the weather, notably rain, but also heat, wind and sunlight. The roof may also comprise the framing or structure which supports the covering.

Typically, structural insulated panels (SIPs) are a composite building material used for roofing and walls. SIPs may consist of an insulating layer of rigid core sandwiched between two layers of structural board. The board can be sheet metal, plywood, cement, magnesium oxide board or oriented strand board. The core may be fabricated from either expanded polystyrene foam or extruded polystyrene foam. The rigid insulation core of the SIP acts as a web, while the sheathing fulfills the function of the flanges. Additionally, a pair of metal planar surfaces can sandwich an insulation to form a similar SIP structure.

In many instances, crimping involves joining two pieces of metal or other ductile material by deforming one or both of them to hold the other. The bend or deformity is called the crimp. A crimp can fasten two or more surfaces together without requiring exterior fasteners. Crimping also forms a tight seal that inhibits penetration by moisture.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates a sectioned side view of an exemplary interior portion carrying an exemplary composite core and an exemplary insulation portion, FIG. 2B illustrates a sectioned side view of an exemplary mounting bracket joined with an exemplary mounting surface, and FIG. 2C illustrates a sectioned side view of an exemplary mounting bracket joined with an exemplary at least one panel, in accordance with an embodiment of the present invention; FIG. 3A illustrates a sectioned side view of an exemplary stabilizer terminal end in a first position, FIG. 3B illustrates a sectioned side view of an exemplary stabilizer terminal end in a second position with one crimp, FIG. 3C illustrates a sectioned side view of an exemplary stabilizer terminal end in a second position with two crimps, and FIG. 3D illustrates a sectioned side view of an exemplary stabilizer terminal end, in accordance with an embodiment of the present invention.

Figure 1:
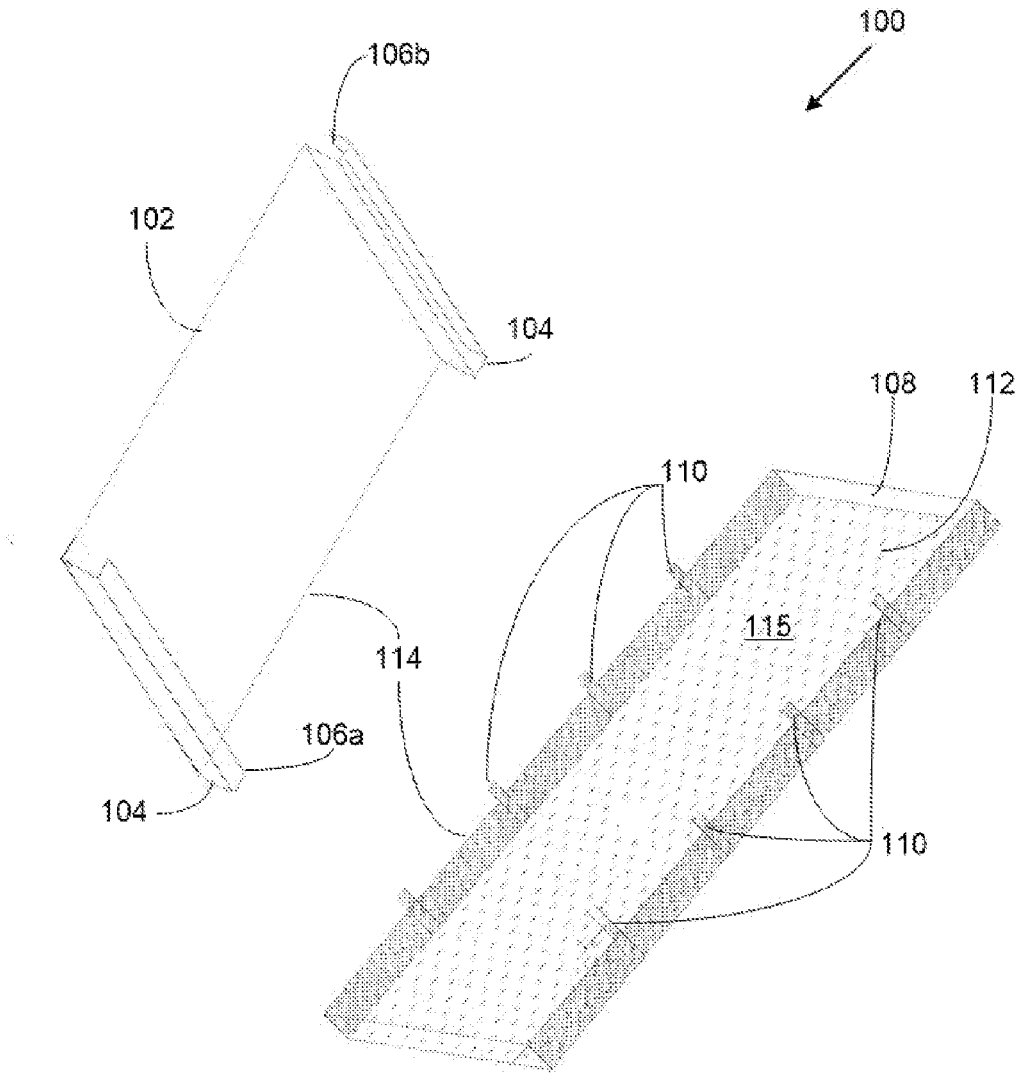
FIG. 1 illustrates a detailed perspective view of an exemplary at least one panel separated into an exemplary exterior portion and an exemplary interior portion with composite core, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art, many careful considerations and compromises; typically, must be made when designing for the optimal manufacture of a commercial implementation a system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of covering systems that may be provided by preferred embodiments of the present invention. In one embodiment of the present invention, the covering system may include structural insulated metal skinned panels that form a modular roof covering system. The system utilizes crimping, bending, and snapping mechansisms to join adjacent panels and fasten to a mounting surface. Thus, external and loose fasteners may be minimoized in this manner. These crimping connections may enable quick installation of a standing seam type roof that is insulated to a high R-value. The system may also use a crimped interior mounting bracket that fastens to the mounting surface for minimizing roof penetrations and eliminating the need for penetrations into the mounting surface and panels.

In some embodiments, the system may include at least one panel configured to at least partially cover a roof and at least one protruding seam on the roof. The panels could be used as a floating cover for a liquid storage tank. However in other embodiments, the panels could be used to cover an excavation of parcel of ground. Or the panels could be used as walls or siding to cover buildings. In some embodiments, a plurality of panels may be arranged adjacent to each other over a mounting surface, such as a roof, to form a protective covering. The covering may help restrict external penetration of the mounting surface and also help minimize space between a plurality of seams. The at least one panel may join with protruding seams that are arranged parallel to one another and spaced at predefined intervals. The protruding seams may include, without limitation, a standing seam or a snap in connection. The at least one panel may utilize a deformation, or crimping to form connections with adjacent panels and attachments with the mounting surface. The at least one panel may contain an insulation portion to help inhibit heat loss.

In some embodiments, the system may include a mounting bracket disposed to attach to the mounting surface. The mounting bracket may include a substantially T-shaped bracket comprising a fastening portion that fastens to the mounting surface, or it may be a Z-shaped or L-shaped bracket with one of the legs removed on the bottom and a generally perpendicular support portion that extends from the fastening portion. The fastening portion may join with the mounting surface by crimping onto various junction points, including, without limitation, a standing seam, a truss, a snap-in seam, or attachment by welding or friction fitting. In some embodiments, the support portion may form an attachment point for joining with the at least one panel. In some embodiments, a terminal end of the support portion may be configured to bend or crimp. This crimping capacity provides the fastening mechanism for joining the at least one panel to the mounting surface, and to adjacently positioned panels.

In some embodiments, the at least one panel may include a structural insulated panel configured to overlay a roof. The fastening mechanism and joining configurations between panels may negate the need for external penetration of the mounting surface, such as tacks or nails to fasten the panels to the mounting surface. The at least one panel may include an exterior portion and an interior portion that join together to enclose an insulation portion. Each portion may include a planar sheet of metal, whereby the exterior portion may include a composition of a galvanized aluminum, and the interior portion may include a composition of a metal lamina. However other compositions may include metals known in the art for roofing, including, without limitation, aluminum, zinc, tin, iron, combinations thereof, and metal alloys.

In some embodiments, the process of fastening the exterior portion and the interior portion may require no external fastening components. The edges of each portion may be bent over, or crimped onto each other and also crimped onto the support portion of the mounting bracket. In some embodiments, the interior portion may include a plurality of bars along a longitudinal edge. The bars may be configured to fold over the edges of the interior and exterior portions to help fasten them together.

In some embodiments, the exterior portion may include an exterior surface, serving as a planar cover against the elements. A pair of stabilizers extend from opposite longitudinal ends of the exterior surface. Each stabilizer may include a stabilizer terminal end that is configured to bend over itself at least one time to form a crimp that holds two surfaces together. The stabilizer terminal end may crimp onto the support portion of the mounting bracket to secure the exterior panel to the mounting bracket, and consequently, the mounting surface. A first exterior position may include the stabilizer terminal ends extended, while a second exterior position may include the stabilizer ends folded over onto the support portion.

In some embodiments, the interior portion may include an interior surface, serving as a planar cover that overlays and engages the mounting surface. The interior surface may include the pair of stabilizers. The pair of stabilizers help the exterior and interior portion sandwich the insulation portion, and also help to secure the at least one panel to the mounting surface. The pair of stabilizers may extend from one side of the interior surface, and be arranged parallel to one another and spaced at predefined intervals. The pair of stabilizers may be configured to join with the mounting surface on the exterior portion. In some embodiments, the pair of stabilizers may deform by crimping over the stabilizer terminal ends to fasten the interior portion to the exterior portion. However, the pair of stabilizers may also crimp onto the support portion of the mounting bracket to further strengthen the attachment between the mounting surface and the at least one panel.

FIG. 1 illustrates a detailed perspective view of an exemplary at least one panel separated into an exemplary exterior portion and an exemplary interior portion having a composite core, in accordance with an embodiment of the present invention. In one embodiment of the present invention, a covering system 100 may include structural insulated metal skinned panels that form a modular roof covering system. The system utilizes a crimping, folding, or snapping mechanism to join adjacent panels and fasten the panels to a mounting surface. Thus, external and loose fasteners may be minimoized in this manner. These crimping connections may enable quick installation of a standing seam type roof that is insulated to a high R-value. The system may also use a crimped interior mounting bracket that fastens to the mounting surface for minimizing roof penetrations and eliminating the need for penetrations into the mounting surface and panels. In some embodiments, this invention may also be used on other types of connecting panels.

In some embodiments, the system may include at least one panel 114 configured to at least partially cover a mounting surface and at least one protruding seam on the mounting surface. The mounting surface may include, without limitation, a roof, a truss, and a barrier, a tank wall, the ground, a beam, a wall, a fence, posts, a floating condition known as mooring lines. In some embodiments, the panel may include an exterior portion 102 and an interior portion 108 that join together over a composite core 115. The composite core may fill the interior space inside the panel. In one embodiment, a portion of the composite core may include an insulation portion 112 configured to provide insulation between the panels. The insulation portion may form both thermal and sound insulation properties, and may include, without limitation, expanded polystyrene foam, polyurethane foam, fiberglass, rubber foams, melamine sponges, structural polymers, and wool.

In some embodiments, the exterior portion may include a pair of stabilizers 104 that extend outwardly from the ends of the panel. A pair of stabilizers 106*a*, 106*b* may be configured to deform, crimp, or snap together. The joining of the stabilizers provides a fastening mechanism that does not utilize fasteners or apertures. The pair of stabilizers may be crimped, bent, or snapped together at a stabilizer end 104. One stabilizer end may have a male stabilizer end 106*a*, while the other has a compatible female stabilizer end 106*b*. In one embodiment, a plurality of panels may be arranged adjacent to each other. The stabilizer terminal ends may crimp together to from a modular type of covering for the roof.

In some embodiments, the interior portion may include a plurality of bars 110 that extend along a longitudinal edge. The bars may be configured to fold over the edges of the interior and exterior portions to help fasten them together. Those skilled in the art will recognize that the fastening mechanism and joining configurations between individual panels and the exterior and interior portions of a panel may negate the need for external penetration of the mounting surface, such as tacks or nails to fasten the panels to the mounting surface.

In some embodiments, a plurality of panels may be arranged adjacent to each other over a mounting surface, such as a roof, to form a protective covering. The panels may be cut to fit into tight places and any geometry within reason is possible. The covering may help restrict external penetration of the mounting surface and also help minimize space between a plurality of seams. The at least one panel may join with protruding seams that are arranged parallel to one another and spaced at predefined intervals. The protruding seams may include, without limitation, a standing seam or a snap in connection. The at least one panel may utilize a deformation, or crimping to form connections with adjacent panels and attachments with the mounting surface.

In some embodiments, the exterior and interior portions may include a planar sheet of metal, whereby the exterior portion may include a composition of a galvanized aluminum, and the interior portion may include a composition of a metal lamina. However other compositions may include metals known in the art for roofing, including, without limitation, aluminum, zinc, tin, iron, combinations thereof, and metal alloys. In one embodiment, each panel may be up to 20 feet long. In some embodiments, other sheeting material may include, without limitation, fiberglass, plastic compounds, glass and other waterproof sheeting materials.

Figure 2A:
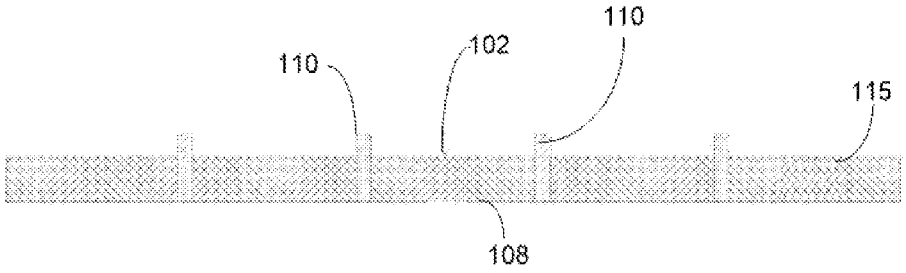
FIGS. 2A, 2B, and 2C illustrate side views of an exemplary at least one panel, where
Figure 2B:
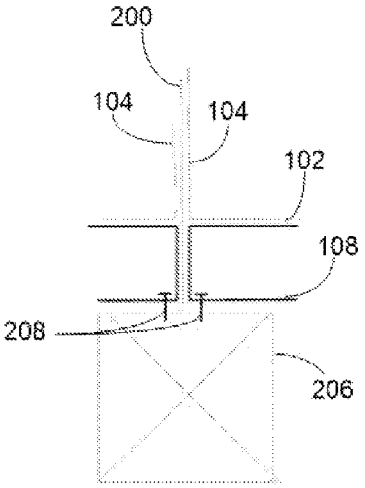
Figure 2C:
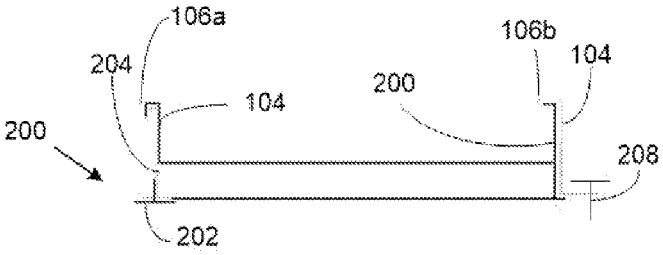

FIGS. 2A, 2B, and 2C illustrate side views of an exemplary at least one panel, where FIG. 2A illustrates a sectioned side view of an exemplary interior portion carrying an exemplary insulation portion, FIG. 2B illustrates a sectioned side view of an exemplary mounting bracket joined with an exemplary mounting surface, and FIG. 2C illustrates a sectioned side view of an exemplary mounting bracket joined with an exemplary at least one panel, in accordance with an embodiment of the present invention. In the present invention, the system may include a mounting bracket 200 disposed to attach to a mounting surface 206. The stabilizers at least partially wrap around the mounting bracket. In some embodiments, the mounting bracket may include a substantially T-shaped bracket or Z-Shaped bracket. The brackets may include a fastening portion 202 that joins with the mounting surface and a generally perpendicular support portion 204. The exterior and adjacent skins are crimped or snapped together to bond together the stabilizers, the stabilizer terminal end, and the mounting bracket. In one embodiment, at least one T-bracket 208 fastens the interior portion to the mounting surface.

In some embodiments, the support portion may include a finishing piece to the panel that extends perpendicularly from the fastening portion. The fastening portion may join with the mounting surface by crimping onto various junction points, including, without limitation, a standing seam, a truss, a snap-in seam, or attachment by welding or friction fitting. In one embodiment, the mounting bracket is approximately 2" in height. The mounting bracket may further include, without limitation, a V-bracket, a Z-Bracket and an L-Bracket. These brackets may be welded, glued, screwed, clamped or otherwise mechanically attached.

In some embodiments, the support portion on the mounting bracket may form an attachment point for joining with the at least one panel. In some embodiments, a terminal end of the support portion may be configured to bend or crimp. This crimping capacity provides the fastening mechanism for joining the at least one panel to the mounting surface, and to adjacently positioned panels. Those skilled in the art will recognize that a structural insulated panel metal roofing can be less expensive compared to similar products due to reduction in construction costs, savings of time and savings in operational costs. The present invention further reduces costs by utilizing crimping to fasten the panels together, and to the roof. This may help prevent heat from entering a building envelope and may help save significantly in heating and cooling.

Figure 3A:
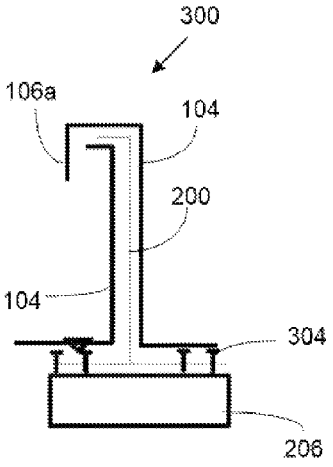
FIGS. 3A, 3B, 3C, and 3D illustrate side views of an exemplary stabilizer terminal end crimping on an exemplary bar and an exemplary support portion, where
Figure 3B:
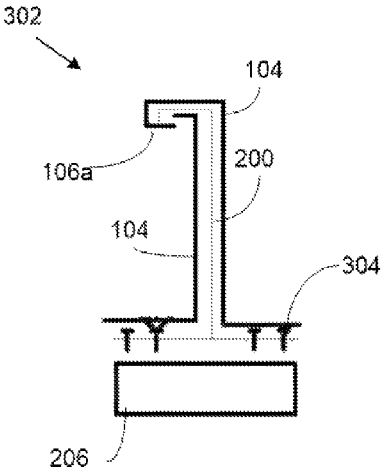
Figure 3C:
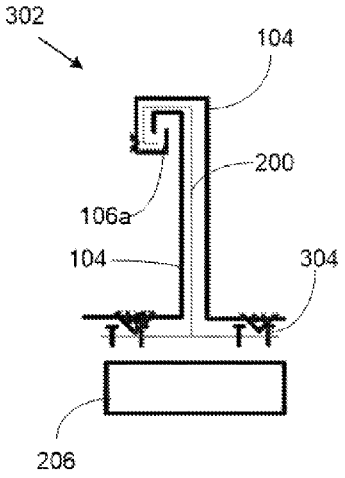
Figure 3D:
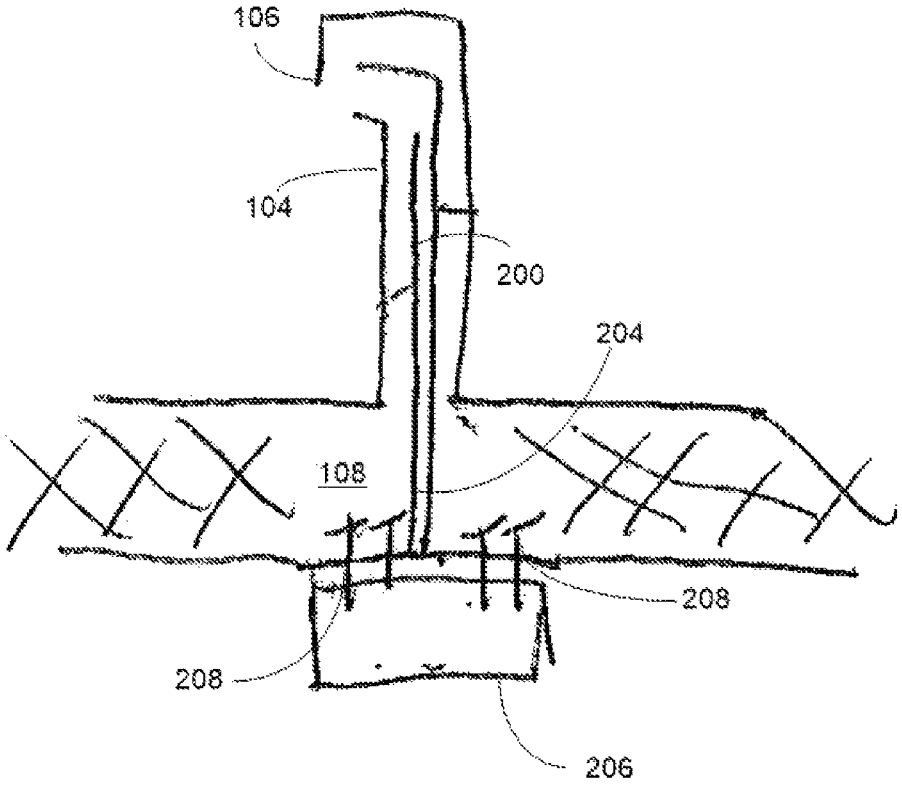

FIGS. 3A, 3B, 3C, and 3D illustrate side views of an exemplary stabilizer terminal end crimping on an exemplary support portion, where FIG. 3A illustrates a sectioned side view of an exemplary stabilizer terminal end in a first position, FIG. 3B illustrates a sectioned side view of an exemplary stabilizer terminal end in a second position with one crimp, FIG. 3C illustrates a sectioned side view of an exemplary stabilizer terminal end in a second position with two crimps, and FIG. 3D illustrates a sectioned side view in a second position, in accordance with an embodiment of the present invention. In the present invention, the process of fastening the exterior portion and the interior portion may require no external fastening components. The edges of each portion may be bent over, or crimped onto each other and also crimped onto the support portion of the mounting bracket. The exterior portion may include an exterior surface, serving as a planar cover against the elements.

In some embodiments, a pair of stabilizers may extend from opposite longitudinal ends of the exterior surface. Each stabilizer may include a stabilizer terminal end that is configured to bend over itself at least one time to form a crimp that holds two surfaces together. The stabilizer terminal end may crimp onto the support portion of the mounting bracket to secure the exterior panel to the mounting bracket, and consequently, the mounting surface. A first exterior position 300 may include the stabilizer terminal ends extended. A second exterior position 302 may include the stabilizer ends folded over onto the support portion. The stabilizer end may fold over one or more times. FIG. 3B illustrates one fold, and FIG. 3B illustrates two folds.

In some embodiments, the interior portion may include an interior surface, serving as a planar cover that overlays and engages the mounting surface. The interior surface may include a pair fop stabilizers. The stabilizers help the exterior and interior portion sandwich the insulation portion, and also help to secure the at least one panel to the mounting surface. The stabilizers may extend from one side of the interior surface, and be arranged parallel to one another and spaced at predefined intervals. In some embodiments, the stabilizers may deform by crimping over a stabilizer terminal end to fasten the interior portion to the exterior portion.

However, the stabilizers may also crimp onto the support portion of the mounting bracket to further strengthen the attachment between the mounting surface and the at least one panel. A mounting bracket fastener 304 may further strengthen the covering system by fastening the mounting bracket onto the mounting surface. The mounting bracket fastener may include, without limitation, a tack, a nail, an adhesive, and a magnet.

In one alternative embodiment, the mounting bracket may include a V-shaped bracket. In yet another alternative embodiment, the panels may be utilized on a wall. In yet another alternative embodiment, the stabilizer terminal ends may include an adhesive to enhance the fastening capacity formed by crimping.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

It will be further apparent to those skilled in the art that at least a portion of the novel method steps and/or system components of the present invention may be practiced and/or located in location(s) possibly outside the jurisdiction of the United States of America (USA), whereby it will be accordingly readily recognized that at least a subset of the novel method steps and/or system components in the foregoing embodiments must be practiced within the jurisdiction of the USA for the benefit of an entity therein or to achieve an object of the present invention. Thus, some alternate embodiments of the present invention may be configured to comprise a smaller subset of the foregoing means for and/or steps described that the applications designer will selectively decide, depending upon the practical considerations of the particular implementation, to carry out and/or locate within the jurisdiction of the USA. For example, any of the foregoing described method steps and/or system components which may be performed remotely over a network (e.g., without limitation, a remotely located server) may be performed and/or located outside of the jurisdiction of the USA while the remaining method steps and/or system components (e.g., without limitation, a locally located client) of the forgoing embodiments are typically required to be located/performed in the USA for practical considerations. In client-server architectures, a remotely located server typically generates and transmits required information to a US based client, for use according to the teachings of the present invention. Depending upon the needs of the particular application, it will be readily apparent to those skilled in the art, in light of the teachings of the present invention, which aspects of the present invention can or should be located locally and which can or should be located remotely. Thus, for any claims construction of the following claim limitations that are construed under 35 USC §112 (6) it is intended that the corresponding means for and/or steps for carrying out the claimed function are the ones that are locally implemented within the jurisdiction of the USA, while the remaining aspect(s) performed or located remotely outside the USA are not intended to be construed under 35 USC §112 (6).

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing modular structural insulated panels that join together by crimping according to the present invention will be apparent to those skilled in the art. Various aspects of the invention have been described above by way of illustration, and the specific embodiments disclosed are not intended to limit the invention to the particular forms disclosed. The particular implementation of the modular structural insulated panels that join together by crimping may vary depending upon the particular context or application. By way of example, and not limitation, the modular structural insulated panels that join together by crimping described in the foregoing were principally directed to a roof covering system comprised of structural insulated metal skinned panels with standing seam or snap-in connections having no exposed penetrations, and including mounting brackets crimped and fastened at the seams. implementations; however, similar techniques may instead be applied to wall paneling in a building, or paneling on the interior of an aircraft or ship, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system comprising:

a mounting bracket, said mounting bracket configured to join with a mounting surface and at least one protruding seam, said mounting bracket comprising a fastening portion configured to deform on said at least one protruding seam, said mounting bracket further comprising a support portion disposed to extend from said fastening portion, said support portion configured to deform; and at least one panel disposed to join with said mounting bracket, said at least one panel further disposed to overlay said mounting surface and said at least one protruding seam, said at least one panel comprising an exterior portion and an interior portion, said exterior portion comprising a pair of stabilizers disposed to extend outwardly, said pair of stabilizers comprising a pair of stabilizer terminal ends configured to deform on said support portion for at least partially joining said exterior portion with said interior portion, said interior portion comprising a plurality of bars configured to deform on said support portion for at least partially joining said exterior portion with said interior portion.

2. The system of claim 1, in which said mounting surface comprises a roof.

3. The system of claim 2, in which said at least one protruding seam comprises at least one standing seam on said roof.

4. The system of claim 3, in which said mounting bracket comprises at least one T or Z or L bracket for at least partially fastening said interior portion to said mounting surface.

5. The system of claim 4, wherein said fastening portion and said support portion are disposed perpendicularly.

6. The system of claim 5, in which said fastening portion deforming on said at least one protruding seam, comprises crimping said fastening portion over said at least one protruding seam at least one time for fastening together.

7. The system of claim 6, in which said at least one panel comprises at least one structural insulated panel.

8. The system of claim 7, in which said at least one panel comprises a length of about 20 feet.

9. The system of claim 8, wherein said exterior portion and said interior portion are configured to at least partially enclose a composite portion, said composite portion comprising an insulation portion, said insulation portion comprising expanded polystyrene foam or some other structural insulating material, said expanded polystyrene foam comprising other polymers or foams facing the exterior portion, the foam sized and dimensioned to at least partially position between said exterior portion and said interior portion.

10. The system of claim 9, in which said exterior portion comprises a planar surface.

11. The system of claim 10, in which said exterior portion comprises a galvanized steel or aluminum composition.

12. The system of claim 11, in which said pair of stabilizers comprise a pair of planar surfaces extending from each longitudinal end of said exterior panel.

13. The system of claim 12, wherein said pair of stabilizer terminal ends are configured to crimp, and/or bend, and/or snap over said support portion at least one time for joining together.

14. The system of claim 13, in which said pair of stabilizer terminal ends comprises a first position, said first position configured to extend linearly.

15. The system of claim 14, in which said pair of stabilizer terminal ends comprises a second position, said second position configured to deform at least one time.

16. The system of claim 15, in which said interior portion comprises a metal lamina composition.

17. The system of claim 16, wherein said plurality of bars are disposed to position at equidistant spaces along a longitudinal edge of said interior portion.

18. The system of claim 17, wherein said crimping configurations are configured to help minimize intrusive penetrations into said mounting surface and said at least one panel.

19. A system comprising:

means for joining a mounting bracket with a mounting surface and at least one protruding seam;

means for crimping a fastening portion on said at least one protruding seam;

means for joining an external portion with an internal portion to form at least one panel;

means for joining said at least one panel with said mounting bracket;

means for crimping a pair of stabilizer terminal ends on a support portion;

means for crimping a plurality of bars over said interior portion and said exterior portion;

means for helping to minimize intrusive penetrations into said mounting surface and said at least one panel through said crimping; and means for helping to minimize a space between a plurality of seams through said crimping.

20. A system consisting of:

a mounting bracket, said mounting bracket comprising a T-bracket, said mounting bracket configured to join with a mounting surface and at least one protruding seam, said mounting surface comprising a roof, said at least one protruding seam comprising at least one standing seam, said mounting bracket comprising a fastening portion configured to crimp on said at least one protruding seam for fastening, said mounting bracket further comprising a support portion disposed to extend from said fastening portion, said support portion configured to form a crimp; and at least one panel disposed to join with said mounting bracket, said at least one panel further disposed to overlay said mounting surface and said at least one protruding seam, said at least one panel comprising at least one structural insulated panel, said at least one panel further comprising a length of about 20 feet, said at least one panel further comprising an exterior portion and an interior portion, said exterior portion and said interior portion configured to at least partially enclose an insulation portion, said insulation portion comprising a fiberglass sized and dimensioned to at least partially position between said exterior portion and said interior portion, said exterior portion comprising a galvanized aluminum composition, said interior portion comprising a metal lamina composition, said exterior portion comprising a pair of stabilizers disposed to extend outwardly, said pair of stabilizers comprising a pair of planar surfaces extending from each longitudinal end of said exterior panel, said pair of stabilizers further comprising a pair of stabilizer terminal ends configured to crimp on said support portion for fastening, said interior portion comprising a plurality of bars configured to deform on said support portion for at least partially joining said exterior portion with said interior portion.

* * * * *